US008789387B2

(12) United States Patent
Kim et al.

(10) Patent No.: US 8,789,387 B2
(45) Date of Patent: Jul. 29, 2014

(54) REFRIGERATOR

(75) Inventors: Kyeong Yun Kim, Seoul (KR); Jang Seok Lee, Seoul (KR); Min Kyu Oh, Seoul (KR); Youn Seok Lee, Seoul (KR); Su Nam Chae, Seoul (KR)

(73) Assignee: LG Electronics Inc., Seoul (KR)

( * ) Notice: Subject to any disclaimer, the term of this patent is extended or adjusted under 35 U.S.C. 154(b) by 973 days.

(21) Appl. No.: 12/499,119

(22) Filed: Jul. 8, 2009

(65) Prior Publication Data

US 2010/0139304 A1 Jun. 10, 2010

(30) Foreign Application Priority Data

Dec. 10, 2008 (KR) ..... 10-2008-0125067

(51) Int. Cl.
*F25D 17/04* (2006.01)

(52) U.S. Cl.
USPC ..... 62/418; 62/417; 62/419; 62/441; 62/444

(58) Field of Classification Search
USPC ..... 62/418, 441, 444, 417, 419
See application file for complete search history.

(56) References Cited

U.S. PATENT DOCUMENTS 2,812,642 A * 11/1957 Jacobs ..... 62/155
5,284,023 A * 2/1994 Silva et al. ..... 62/77
6,735,976 B2 5/2004 Lee
6,997,008 B2 2/2006 Lee
7,003,973 B2 2/2006 Lee
7,040,118 B2 5/2006 Jung
7,114,345 B2 10/2006 Kim
7,185,509 B2 3/2007 Lee
7,188,490 B2 3/2007 Jeong
7,322,209 B2 1/2008 Hwang
2004/0040338 A1* 3/2004 Lee et al. ..... 62/441
2004/0139763 A1* 7/2004 Jeong et al. ..... 62/448
2005/0218766 A1 10/2005 Hwang
2007/0044498 A1* 3/2007 Kang et al. ..... 62/276

FOREIGN PATENT DOCUMENTS

CN 1474129 A 2/2004
JP 7-19704 1/1995

OTHER PUBLICATIONS

Chinese Office Action dated Jan. 4, 2011 for Application No. 2009-10163897, with English translation. 14 pages.

* cited by examiner

*Primary Examiner* — Cassey D Bauer
(74) *Attorney, Agent, or Firm* — Fish & Richardson P.C.

(57) ABSTRACT

A refrigerator, in which a main body includes a refrigerating chamber and a freezing chamber. A cold air generation chamber for the freezing chamber is provided on an uppermost part of the main body, communicates with the freezing chamber, and houses a freezing chamber evaporator. A cold air generation chamber for the refrigerating chamber is provided separate from the cold air generation chamber for the freezing chamber and houses a refrigerating chamber evaporator.

18 Claims, 7 Drawing Sheets

REFRIGERATOR

CROSS REFERENCE TO RELATED APPLICATION

This application claims the benefit of the Patent Korean Application No. 10-2008-0125067, filed on Dec. 10, 2008, which is hereby incorporated by reference as if fully set forth herein.

FIELD OF THE DISCLOSURE

The present disclosure relates to a refrigerator.

BACKGROUND

A refrigerator is an apparatus that can freeze or refrigerate stored goods received inside predetermined storage chambers using a four-step cycle including compression-condensation-expansion-evaporation of cold air. A refrigerator includes a main body in which storage space is provided, a door provided in the main body to open/close the storage space, a cold air generation chamber that houses an evaporator to generate cold air, and a machine room in which apparatuses such as a compressor and a condenser are received.

SUMMARY OF THE DISCLOSURE

A refrigerator includes a main body, a refrigerating chamber defined at a first portion of the main body, and a freezing chamber defined at a second portion of the main body. The second portion of the main body may be different than the first portion of the main body. The refrigerator also includes a cold air generation chamber for the freezing chamber that is defined at an uppermost part of the main body, that communicates with the freezing chamber, and that houses a freezing chamber evaporator configured to generate cold air used in regulating temperature of the freezing chamber. The refrigerator further includes a machine room provided on the uppermost part of the main body and a cold air generation chamber for the refrigerating chamber provided separate from the cold air generation chamber for the freezing chamber and accommodating a refrigerating chamber evaporator configured to generate cold air used in regulating temperature of the refrigerating chamber.

Implementations may include one or more of the following features. For example, the refrigerator may include a freezing chamber cold air fan that is configured to move cold air generated from the freezing chamber evaporator toward the freezing chamber and that is provided inside the cold air generation chamber for the freezing chamber. The freezing chamber and the cold air generation chamber for the freezing chamber may be partitioned by a wall. The refrigerator also may include a cold air inlet that is provided between the freezing chamber and the cold air generation chamber for the freezing chamber and that is configured to guide cold air from the freezing chamber into the cold air generation chamber for the freezing chamber and a cold air outlet that is configured to guide cold air from the cold air generation chamber for the freezing chamber toward the freezing chamber.

In addition, the refrigerator may include a guide duct that is connected to the cold air outlet and that is configured to guide cold air discharged from the cold air outlet to the freezing chamber and an outlet that is defined in the guide duct and that is configured to allow cold air guided by the guide duct to pass into the freezing chamber. The freezing chamber evaporator may be disposed between the cold air inlet and the cold air outlet, and the freezing chamber cold air fan may be installed adjacent to the cold air outlet. The freezing chamber evaporator and the freezing chamber cold air fan may be disposed so that air flowing into the cold air inlet sequentially passes through the freezing chamber evaporator and the freezing chamber cold air fan to the cold air outlet.

Further, the refrigerator may include a drain pan that is located in the cold air generation chamber for the freezing chamber, that is installed below the freezing chamber evaporator, and that is configured to collect defrosted water generated from the freezing chamber evaporator. The refrigerator also may include an orifice provided around the freezing chamber cold air fan and an orifice hole that is provided in the orifice and that is configured to guide movement of air.

In some examples, the refrigerator may include a cold air fan motor configured to drive the freezing chamber cold air fan and a motor supporting part that is provided in the orifice and that is configured to support the cold fan motor. In these examples, the cold air fan motor may be disposed between the freezing chamber cold air fan and the freezing chamber evaporator.

The refrigerator may include a guide member that is provided on one side of the orifice hole adjacent to the freezing chamber cold air fan and that is configured to guide air discharged by the cold air fan toward the cold air outlet. The refrigerator also may include a compressor and a condenser that are accommodated in the machine room. The machine room may be provided on the uppermost side of the main body over the refrigerating chamber and the cold air generation chamber for the refrigerating chamber, and may be disposed on a side surface of the cold air generation chamber for the freezing chamber.

In some implementations, the refrigerator may include a cover member that is installed on a surface of the machine room in a manner that enables removal and replacement of the cover member and that is configured to cover an interior space defined by the machine room. In these implementations, the refrigerator may include communication holes that are defined in the cover member and that enable communication of air between the interior space defined by the machine room and an exterior of the refrigerator. The cold air generation chamber for the refrigerating chamber may be provided in a rear of the refrigerating chamber and may be partitioned from the refrigerating chamber by a partitioning wall.

In another aspect, a refrigerator includes a main body, a refrigerating chamber defined at a first portion of the main body, and a freezing chamber defined at a second portion of the main body. The second portion of the main body is different than the first portion of the main body. The refrigerator also includes a cold air generation chamber for the freezing chamber that is defined at an uppermost part of the main body and that is configured to generate cold air used in regulating temperature of the freezing chamber. The refrigerator further includes a cold air generation chamber for the refrigerating chamber that is defined inside the main body adjacent to the refrigerating chamber and that is configured to generate cold air used in regulating temperature of the refrigerating chamber. In addition, the refrigerator includes a machine room provided on the uppermost part of the main body adjacent to the cold air generation chamber for the freezing chamber.

Implementations may include one or more of the following features. For example, the cold air generation chamber for the freezing chamber may be configured to communicate with the freezing chamber. The refrigerator may include a freezing chamber evaporator that is located within the cold air generation chamber for the freezing chamber and a freezing chamber cold air fan that is located within the cold air generation chamber for the freezing chamber adjacent to the freezing chamber evaporator and that is configured to move air toward the freezing chamber.

In some implementations, the refrigerator may include a cold air inlet that is disposed between the cold air generation chamber for the freezing chamber and the freezing chamber and that is configured to guide air from the freezing chamber into the cold air generation chamber for the freezing chamber and a cold air outlet that is configured to guide air from the cold air generation chamber for the freezing chamber to the freezing chamber. The freezing chamber evaporator may be disposed between the cold air inlet and the cold air outlet. The cold air fan for the freezing chamber may be installed adjacent to the cold air outlet and may be configured to move air passing through the freezing chamber evaporator toward the cold air outlet. The refrigerator may include a guide duct that is connected to the cold air outlet, that is disposed inside the freezing chamber, and that is configured to guide cold air discharged from the cold air outlet throughout the freezing chamber.

The details of one or more implementations are set forth in the accompanying drawings and the description below. Other features will be apparent from the description and drawings, and from the claims.

DETAILED DESCRIPTION

Figure 1:
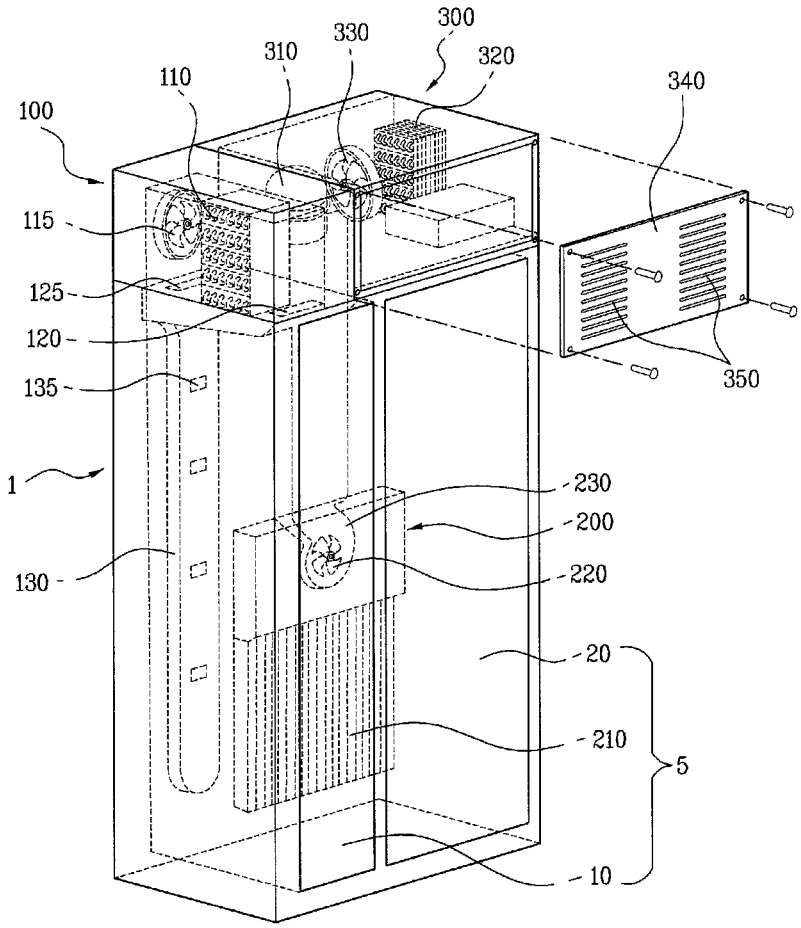
FIG. 1 is a perspective view of a refrigerator.

FIG. 1 illustrates an example of a refrigerator. The refrigerator includes a main body 1 that defines an external appearance of the refrigerator and includes storage chambers inside the main body 1. The storage chambers 5 are divided into a freezing chamber 10 and a refrigerating chamber 20.

The freezing chamber 10 and the refrigerating chamber are positioned in parallel within the main body 1. A cold air generation chamber is provided for each of the freezing chamber 10 and the refrigerating chamber 20 so that storage goods are preserved in a freezing storage in the freezing chamber 10 or a cold storage in the refrigerating chamber 20.

A cold air generation chamber for a refrigerating chamber 200 is provided in the rear of the refrigerating chamber 20. The cold air generation chamber for a refrigerating chamber 200 generates cold air that flows to the refrigerating chamber 20 to cool the refrigerating chamber 20. A cold air generation chamber for a freezing chamber 100 is provided on an upper part of the freezing chamber 10 at an upper surface of the main body 1. The cold air generation chamber for a freezing chamber 100 generates cold air that flows to the freezing chamber 10 to cool the freezing chamber 10. A machine room 300 in which a compressor 310 and a condenser 320 are received is installed at the upper surface of the main body 1 next to the cold air generation chamber for the freezing chamber 100.

The cold air generation chamber for the freezing chamber 100 includes a freezing chamber evaporator 110 and a freezing chamber cold air fan 115. The freezing chamber cold air fan 115 pulls air from inside the freezing chamber 10 in the direction of the freezing chamber evaporator 110 and then discharges air cooled by the freezing chamber evaporator 110 in the direction of the freezing chamber 10.

The cold air generation chamber for the freezing chamber 100 is surrounded by a heat insulating material. The heat insulating material insulates the cold air generation chamber for the freezing chamber 100 from an exterior of the refrigerator.

The freezing chamber evaporator 110 has a predetermined quadrangular block shape to correspond to an inner space of the cold air generation chamber for the freezing chamber 100.

The cold air generation chamber for the freezing chamber 100 includes a cold air inlet 120 that communicates the cold air generation chamber for the freezing chamber 100 with the freezing chamber 10 and guides air flowing from the freezing chamber 10 the cold air generation chamber for the freezing chamber 100. The cold air generation chamber for the freezing chamber 100 also includes a cold air outlet 125 that is installed adjacent to the freezing chamber cold air fan 115 and guides air discharged from the cold air generation chamber for the freezing chamber 100 to the freezing chamber 10.

The freezing chamber evaporator 110 is installed between the cold air outlet 125 and the cold air inlet 120.

A guide duct 130 is connected to the cold air outlet 125. The guide duct 130 serves to evenly distribute the cold air discharged from the cold air outlet 125 to the inside of the freezing chamber 10.

In operation of the refrigerator, the cold air is subject to a circulation flow process of the freezing chamber 10→the cold air inlet 120→the freezing chamber evaporator 110→the freezing chamber cold air fan 115→the cold air outlet 125→the guide duct 130→the freezing chamber 10.

Although the freezing chamber cold air fan 115 is described as being installed adjacent to the cold air outlet 125, in other examples, the freezing chamber cold air fan 115 is installed adjacent to the cold air inlet 120. In these other examples, the freezing chamber cold air fan 115 draws cold air from the freezing chamber 10 through the cold air inlet 120 and expels air in the direction of the freezing chamber evaporator 110.

The cold air generation chamber for the refrigerating chamber 200 is installed adjacent to the refrigerating chamber 20 inside the main body 1, rather being installed on the upper part of the main body 1 with the cold air generation chamber for the freezing chamber 100. The cold air generation chamber for the refrigerating chamber 200 supplies cold air to the refrigerating chamber 20.

The cold air generation chamber for the refrigerating chamber 200 is installed in a rear surface side of the refrigerating chamber 20 and is partitioned from the refrigerating chamber 20 by a partitioning wall.

The cold air generation chamber for the refrigerating chamber 200 includes a refrigerating chamber evaporator 210 and a refrigerating chamber cold air fan 220 that supplies the cold air generated from the refrigerating chamber evaporator 210 toward the refrigerating chamber 20. A fan case 230 accommodates the refrigerating chamber cold air fan 220.

The machine room 300 is provided on one side of the cold air generation chamber for the freezing chamber 100. The inside of the machine room 300 houses a condenser 320 that condenses cold air, a condensation fan 330 provided on one side of the condenser 320, and a compressor 310 that compresses the cold air.

The cold air generation chamber for the freezing chamber 100 and the machine room 300 are positioned at an upper part of the main body 1 adjacent to one another.

The compressor 310, the condensation fan 330, and the condenser 320 are positioned in a row and are positioned in a line generally parallel to a plane of the access opening of the refrigerating chamber 20.

A cover member 340 is provided in front of the machine room 300 to serve to cover the inside thereof so that the inside of the machine room 300 is not shown from the exterior of the refrigerator. The cover member 340 has one or more communicating holes 350 that enable passage of air between an outside of the refrigerator and the inside of the machine room 300. Air from the outside of the refrigerator is capable of cooling the condenser 320 and is supplied through the communicating holes 350 of the cover member 340.

The height of the upper surface of the machine room 300 is the same as the height of the cold air generation chamber for the freezing chamber 100.

Figure 2:
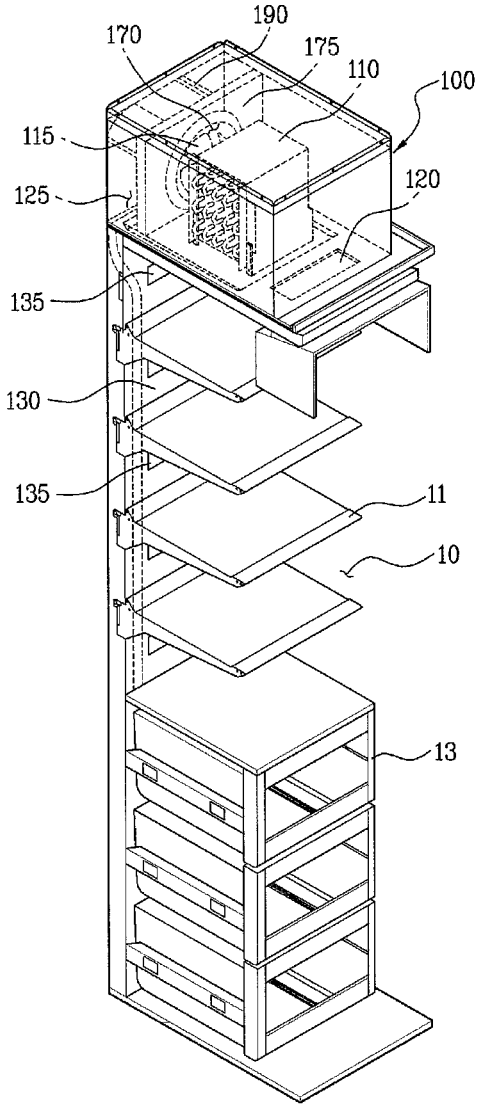
FIG. 2 is a structure view of a freezing chamber and a cold air generation chamber for the freezing chamber in a refrigerator.

FIG. 2 illustrates an example of an inner structure of a freezing chamber 10 and a structure of a cold air generation chamber for the freezing chamber 100.

As shown, a plurality of shelves 11 are disposed up and down inside the freezing chamber 10. Drawer-type storage chambers 13 are provided below the shelves 11.

The guide duct 130 is provided in the rear of the shelves 11 and the storage chambers 13. The guide duct 130 transfers the cold air generated from the cold air generation chamber for the freezing chamber 100 toward the shelves 11 and the storage chambers 13.

A plurality of cold air outlets 135 that discharge cold air are provided in the guide duct 130. The cold air outlets 135 are positioned between adjacent shelves, and are also positioned behind the storage chambers 13 to allow the cold air to be supplied evenly to the respective shelves 11 and the respective storage chambers 13.

The cold air generation chamber for the freezing chamber 100 has a quadrangular box shape. The horizontal width of the cold air generation chamber 100 is narrower than a width of the entirety of the freezing chamber 100.

The width of the machine room 300 along which the condenser 320 (see FIG. 1), the compressor 310, and the condensation fan 330 are positioned is wider than a width of the refrigerating chamber 20 (see FIG. 1). Accordingly, the width of the cold air generation chamber for the freezing chamber 100 is narrower than the width of the freezing chamber 10 to enable the portion of the main body 1 above the freezing chamber 10 to accommodate the portion of the machine room 300 that extends beyond the width of the refrigerating chamber 20.

Figure 3:
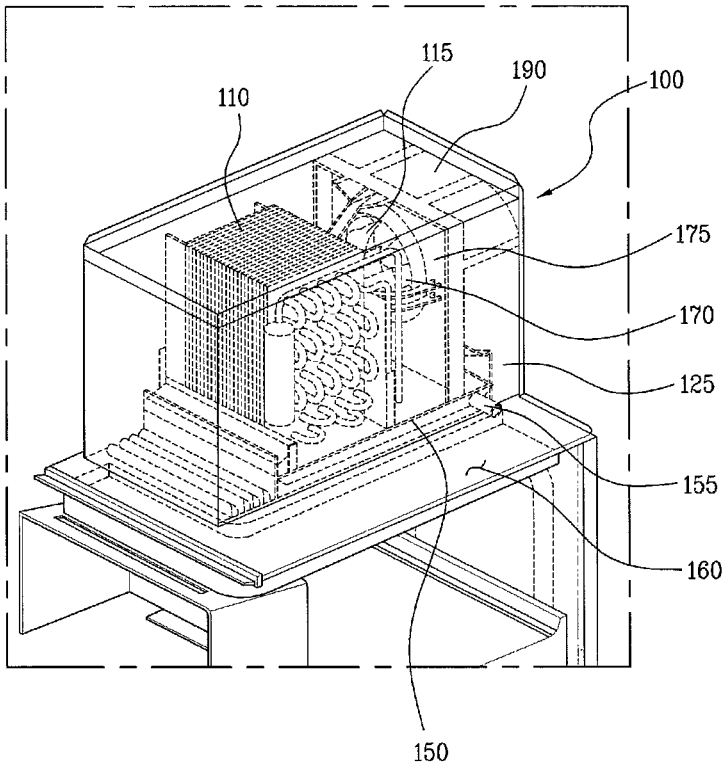
FIG. 3 is a structure view of a cold air generation chamber for a freezing chamber.

FIG. 3 illustrates an example of the inside of the cold air generation chamber for the freezing chamber 100. The cold air generation chamber for the freezing chamber 100 includes a drain pan 150 that receives defrosted water generated at the time of defrosting and discharges it to the exterior of the refrigerator. The drain pan 150 is provided below the freezing chamber evaporator 110.

A drain hole 155 is provided in the drain pan 150 so that defrosted water is discharged from the drain pan 150 and the discharged defrosted water is discharged to the outside of the cold air generation chamber for the freezing chamber 100 along a flow passage 160 provided around the drain pan 150.

The freezing chamber cold air fan 115 is operated by a cold air fan motor 116 (see FIG. 4) disposed between the freezing chamber cold air fan 115 and the freezing chamber evaporator 110.

An orifice 175 that has a predetermined orifice hole 170 is provided around the freezing chamber cold air fan 115, and the cold air fan motor 116 is supported by a motor supporting part extended from the orifice 175.

A guide member 190 is provided on one surface of the orifice 175. The guide member 190 guides cold air discharged from the freezing chamber cold air fan 115 toward the cold air outlet 125 provided below the freezing chamber cold air fan 115.

Figure 4:
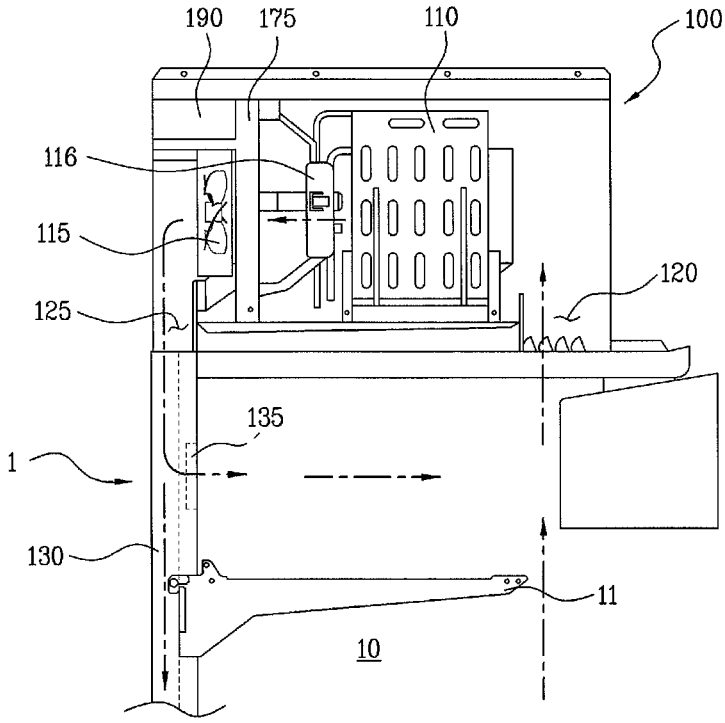
FIG. 4 is a structure side cross-sectional view of a cold air generation chamber for a freezing chamber.

FIG. 4 illustrates a cross-section of the cold air generation chamber for the freezing chamber 100 and a portion of the freezing chamber 10. As shown, the freezing chamber evaporator 110 and the freezing chamber cold air fan 115 are disposed between the cold air inlet 120 and the cold air outlet 125. The guide member 190 is disposed on a wall between the orifice 175 and the cold air generation chamber for the freezing chamber 100 and guides the air discharged from the freezing chamber cold air fan 115 toward the cold air outlet 125.

The cold air fan motor 116 is disposed between the freezing chamber cold air fan 115 and the freezing chamber evaporator 110. The cold air fan motor 116 is subject to the cooling process of air flowing into the freezing chamber cold air fan 115 from the freezing chamber evaporator 110.

Through the cooling process as described above, it is possible to reduce the likelihood of the cold air fan motor 116 being over-heated.

The guide duct 130 is provided between the freezing chamber 10 and the inner wall of the main body 1, and a cold air outlet 135 is defined on an upper surfaces of the shelf 11 and the freezing chamber 10 or on a central portion of the space between adjacent shelves. The guide duct 130 includes multiple cold air outlets that are defined along the guide duct 130 and that distribute cooled air throughout the freezing chamber 10.

Figure 5:
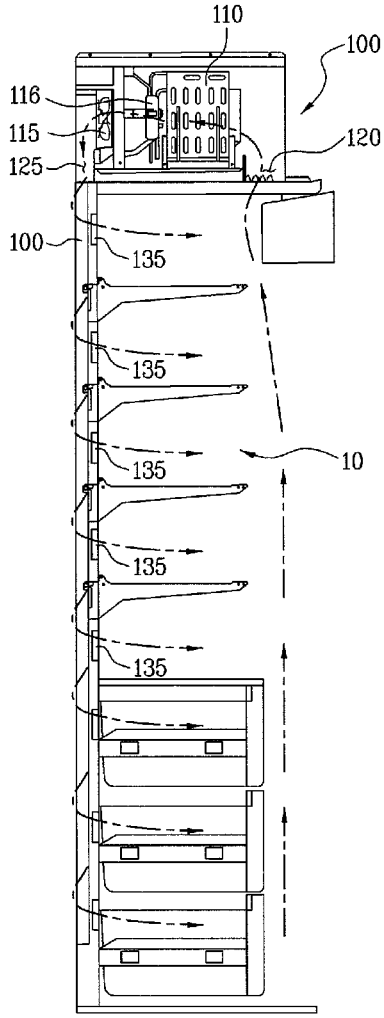
FIG. 5 is a side view showing a structure in which cold air is circulated between a freezing chamber and a cold air generation chamber for the freezing chamber in a refrigerator.
Figure 6:
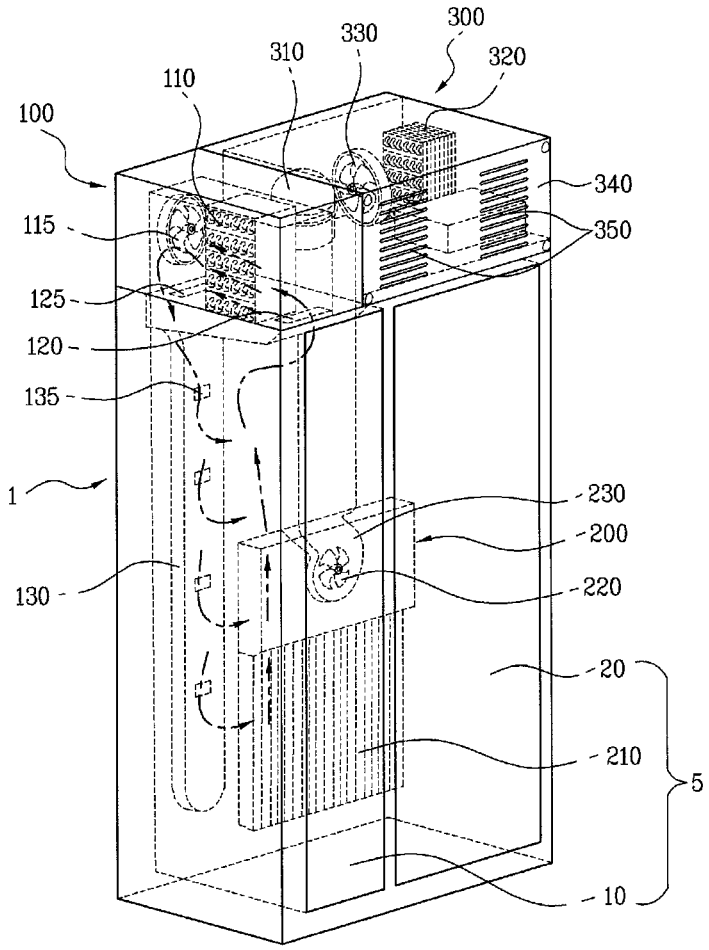
FIG. 6 is a perspective view showing a structure in which cold air is circulated between a freezing chamber and a cold air generation chamber for the freezing chamber in a refrigerator.

FIGS. 5 and 6 illustrate operation of the freezing chamber 10. As described above, the freezing chamber 10 is driven by a separate-cooling type from the refrigerating chamber 20 and the cold air generated by the cold air generation chamber for the freezing chamber 100 flows into only the freezing chamber 10.

Reviewing the circulation of the cold air of the structure of the freezing chamber 10 and the cold air generation chamber for the freezing chamber 100, air that exists inside the freezing chamber 10 and has a certain degree of heat removed by stored goods moves to the cold air inlet 120 provided between the freezing chamber 10 and the cold air generation chamber for the freezing chamber 100 by the operation of the freezing chamber cold air fan 115.

The air passing through the cold air inlet 120 is passes through the freezing chamber evaporator 110 undergoes a heat-exchange process in which air passing through the cold air inlet 120 is cooled. Air having a lower temperature moves to the freezing chamber cold air fan 115.

The freezing chamber cold air fan 115 is a centrifugal fan or an axial flow fan. The cold air that passes through the freezing chamber evaporator 110 by the freezing chamber cold air fan 115 next passes through the cold air outlet 125 provided adjacent to the surrounding of the freezing chamber cold air fan 115. The guide duct 130 connected to the cold air outlet 125 receives the cooled air passing through the cold air outlet 125 and guides it to the freezing chamber. The guide duct 130 expels air throughout the freezing chamber 10 through the cold air outlets 135.

Figure 7:
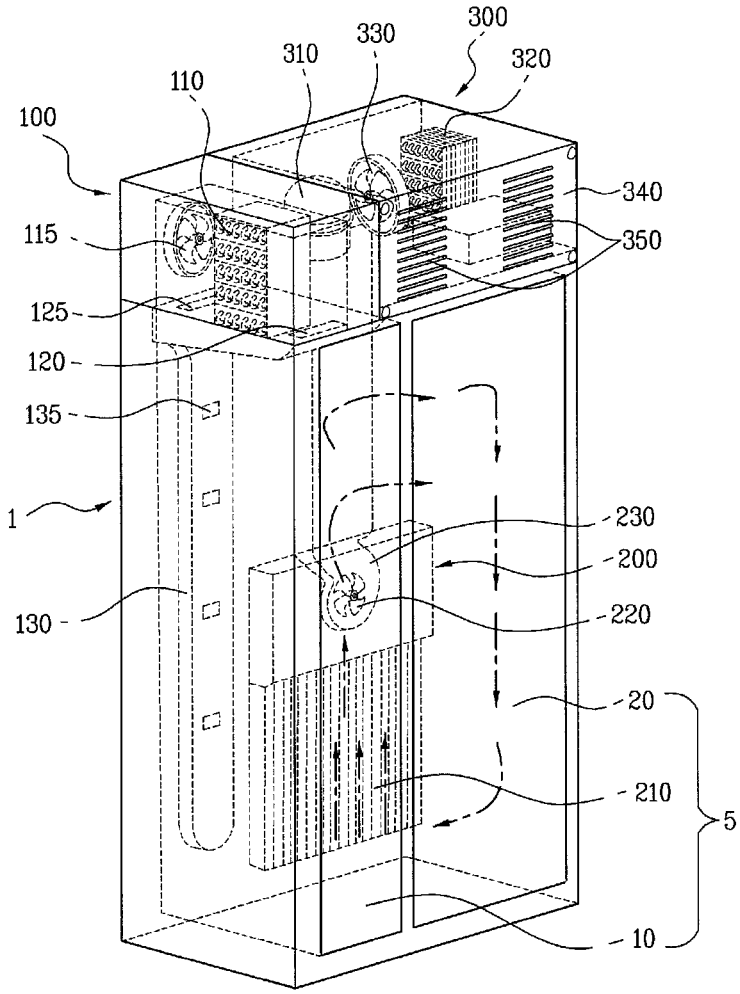
FIG. 7 is a perspective view showing a structure in which cold air is circulated between a refrigerating chamber and a cold air generation chamber for the refrigerating chamber in a refrigerator.

FIG. 7 illustrates operation of the refrigerating chamber 10 and shows an order in which cold air is supplied to the refrigerating chamber 20. First, if the refrigerating chamber cold air fan 220 operates, the air inside the refrigerating chamber 20 moves to the lower part of the refrigerating chamber heat-exchanger 210 by the rotation of the refrigerating chamber cold air fan 220.

The air that moves to the lower part of the refrigerating chamber heat-exchanger 210 is drawn through the refrigerating chamber heat-exchanger 210 by force of the refrigerating chamber cold air fan 220. As the air passes through the refrigerating chamber heat-exchanger 210, a heat-exchange process occurs between the air and the refrigerating chamber heat-exchanger 210, thereby cooling the air passing through the refrigerating chamber heat-exchanger 210.

The cooled air moves to the refrigerating chamber cold air fan 220 and flows inside the fan casing 230 surrounding the refrigerating chamber cold air fan 220. The cooled air is discharged to the outside of the fan casing 230 and then is supplied again to the refrigerating chamber 20 from an outlet of the fan casing 230.

In order that cold air is supplied to the freezing chamber evaporator 110 or the refrigerating chamber evaporator 210, after being compressed by the compressor 310, the cold air moves to the condenser 320 to be flowed into the respective evaporators, going through the condensation process and the predetermined expansion apparatus.

At this time, if the condensation fan 330 operates for the heat-exchange operation between the condenser 320 and the air, the external air of the machine room 300 is flowed in the direction of a communication hole 350 defined closer to the condenser 320, among communication holes 350 defined on the cover member 340, by the operation of the condensation fan 330 and then is subject to the heat-exchange operation with the condenser 320, thereby being discharged into the communication hole 350 defined on the other portion.

Through the air circulation operation as described above, the heat-exchange operation between the high-temperature cold air and the indoor air is made in the condenser 320.

In some implementations, the machine room is positioned on the uppermost part of the main body so that a larger space is available for storage space of the freezing chamber and refrigerating chamber. Accordingly, positioning the machine room on the uppermost part of the main body may have an advantage that the storage space of stored goods can be enlarged, as compared to refrigerators in which the machine room is positioned in the lower rear of the freezing chamber or refrigerating chamber.

Also, the depth (e.g., the distance between refrigerator door and back of the refrigerator) of the refrigerator may be reduced by putting the portion of the cold air generation chamber on the uppermost part of the main body. As such, the space occupied by the refrigerator can be reduced, and provide an advantage in efficiency of utilization of indoor space.

It will be understood that various modifications may be made without departing from the spirit and scope of the claims. For example, advantageous results still could be achieved if steps of the disclosed techniques were performed in a different order and/or if components in the disclosed systems were combined in a different manner and/or replaced or supplemented by other components. Accordingly, other implementations are within the scope of the following claims.

What is claimed is:

1. A refrigerator, comprising:

a main body having an opening defining a front of the main body, a back wall that is opposite the front of the main body and that defines a back of the main body, and an upper wall that extends between the front of the main body and the back of the main body;

a refrigerating chamber defined at a first portion of the main body below the upper wall;

a freezing chamber defined at a second portion of the main body below the upper wall, the freezing chamber being arranged side by side with the refrigerating chamber;

a cold air generation chamber for the freezing chamber that is defined at an uppermost part of the main body, that communicates with the freezing chamber, and that houses a freezing chamber evaporator configured to generate cold air used in regulating temperature of the freezing chamber, the cold air generation chamber for the freezing chamber being located on the upper wall and extending from the back of the main body to the front of the main body;

a cold air generation chamber for the refrigerating chamber provided separate from the cold air generation chamber for the freezing chamber and accommodating a refrigerating chamber evaporator configured to generate cold air used in regulating temperature of the refrigerating chamber;

a machine room that services the freezing chamber evaporator and the refrigerating chamber evaporator, the machine room being located on the upper wall, extending from the back of the main body to the front of the main body, and being positioned beside the cold air generation chamber for the freezing chamber;

a cold air inlet that is provided between the freezing chamber and the cold air generation chamber for the freezing chamber and that is configured to guide cold air from the freezing chamber into the cold air generation chamber for the freezing chamber;

a cold air outlet that is configured to guide cold air from the cold air generation chamber for the freezing chamber toward the freezing chamber;

a guide duct that is extended from the cold air outlet downwards on a rear wall of the freezing chamber and that is configured to guide cold air discharged from the cold air outlet to the freezing chamber; and a plurality of outlets that are defined in the guide duct and that are configured to allow cold air guided by the guide duct to pass into the freezing chamber, wherein the cold air generation chamber for the refrigerating chamber is provided behind the refrigerating chamber.

2. The refrigerator according to claim 1, further comprising:

a freezing chamber cold air fan that is configured to move cold air generated from the freezing chamber evaporator toward the freezing chamber and that is provided inside the cold air generation chamber for the freezing chamber.

3. The refrigerator according to claim 2, wherein the freezing chamber and the cold air generation chamber for the freezing chamber are partitioned by a wall.

4. The refrigerator according to claim 3, wherein the freezing chamber evaporator is disposed between the cold air inlet and the cold air outlet, and the freezing chamber cold air fan is installed adjacent to the cold air outlet.

5. The refrigerator according to claim 4, wherein the freezing chamber evaporator and the freezing chamber cold air fan are disposed so that air flowing into the cold air inlet sequentially passes through the freezing chamber evaporator and the freezing chamber cold air fan to the cold air outlet.

6. The refrigerator according to claim 3, further comprising:

a drain pan that is located in the cold air generation chamber for the freezing chamber, that is installed below the freezing chamber evaporator, and that is configured to collect defrosted water generated from the freezing chamber evaporator.

7. The refrigerator according to claim 3, further comprising:

an orifice provided around the freezing chamber cold air fan; and an orifice hole that is provided in the orifice and that is configured to guide movement of air.

8. The refrigerator according to claim 7, further comprising:

a cold air fan motor configured to drive the freezing chamber cold air fan; and a motor supporting part that is provided in the orifice and that is configured to support the cold air fan motor.

9. The refrigerator according to claim 8, wherein the cold air fan motor is disposed between the freezing chamber cold air fan and the freezing chamber evaporator.

10. The refrigerator according to claim 7, further comprising:

a guide member that is provided on one side of the orifice hole adjacent to the freezing chamber cold air fan and that is configured to guide air discharged by the cold air fan toward the cold air outlet.

11. The refrigerator according to claim 1, further comprising:

a compressor and a condenser that are accommodated in the machine room, wherein the machine room is provided on the uppermost side of the main body over the refrigerating chamber and the cold air generation chamber for the refrigerating chamber, and is disposed on a side surface of the cold air generation chamber for the freezing chamber.

12. The refrigerator according to claim 11, further comprising:

a cover member that is installed on a surface of the machine room in a manner that enables removal and replacement of the cover member and that is configured to cover an interior space defined by the machine room.

13. The refrigerator according to claim 12, further comprising:

communication holes that are defined in the cover member and that enable communication of air between the interior space defined by the machine room and an exterior of the refrigerator.

14. The refrigerator according to claim 1, wherein the cold air generation chamber for the refrigerating chamber is partitioned from the refrigerating chamber by a partitioning wall.

15. A refrigerator, comprising:

a main body having an opening defining a front of the main body, a back wall that is opposite the front of the main body and that defines a back of the main body, and an upper wall that extends between the front of the main body and the back of the main body;

a refrigerating chamber defined at a first portion of the main body below the upper wall;

a freezing chamber defined at a second portion of the main body below the upper wall, the freezing chamber being arranged side by side with the refrigerating chamber;

a cold air generation chamber for the freezing chamber that is defined at an uppermost part of the main body and that is configured to generate cold air used in regulating temperature of the freezing chamber, the cold air generation chamber for the freezing chamber being located on the upper wall and extending from the back of the main body to the front of the main body;

a cold air generation chamber for the refrigerating chamber that is defined inside the main body adjacent to the refrigerating chamber and that is configured to generate cold air used in regulating temperature of the refrigerating chamber;

a machine room for the cold air generation chamber for the freezing chamber and the cold air generation chamber for the refrigerating chamber, the machine room being located on the upper wall, extending from the back of the main body to the front of the main body, and being positioned beside the cold air generation chamber for the freezing chamber;

a cold air inlet that is disposed between the cold air generation chamber for the freezing chamber and the freezing chamber and that is configured to guide air from the freezing chamber into the cold air generation chamber for the freezing chamber;

a cold air outlet that is configured to guide air from the cold air generation chamber for the freezing chamber to the freezing chamber;

a guide duct that is extended from the cold air outlet downwards on a rear wall of the freezing chamber and that is configured to guide cold air discharged from the cold air outlet to the freezing chamber; and a plurality of outlets that are defined in the guide duct and that is configured to allow cold air guided by the guide duct to pass into the freezing chamber, wherein the cold air generation chamber for the refrigerating chamber is provided behind the refrigerating chamber.

16. The refrigerator according to claim 15, wherein the cold air generation chamber for the freezing chamber is configured to communicate with the freezing chamber, further comprising:

a freezing chamber evaporator that is located within the cold air generation chamber for the freezing chamber; and a freezing chamber cold air fan that is located within the cold air generation chamber for the freezing chamber adjacent to the freezing chamber evaporator and that is configured to move air toward the freezing chamber.

17. The refrigerator according to claim 16, wherein the freezing chamber evaporator is disposed between the cold air inlet and the cold air outlet.

18. The refrigerator according to claim 17, wherein the freezing chamber cold air fan is installed adjacent to the cold air outlet and is configured to move air passing through the freezing chamber evaporator toward the cold air outlet.

* * * * *